US007055598B2

(12) United States Patent
Ross et al.

(10) Patent No.: US 7,055,598 B2
(45) Date of Patent: Jun. 6, 2006

(54) FLUID FLOW CONTROL DEVICE AND METHOD FOR USE OF SAME

(75) Inventors: Colby M. Ross, Carrollton, TX (US); Ralph H. Echols, Dallas, TX (US); Brock W. Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 10/227,935

(22) Filed: Aug. 26, 2002

(65) Prior Publication Data

US 2004/0035578 A1 Feb. 26, 2004

(51) Int. Cl.
*E21B 43/12* (2006.01)

(52) U.S. Cl. ..... 166/236; 166/233; 166/386; 166/332.1; 166/332.2

(58) Field of Classification Search ..... 166/205, 166/233, 236, 196, 386, 334.4, 332.1, 332.2, 166/334.1, 296, 235
See application file for complete search history.

(56) References Cited

U.S. PATENT DOCUMENTS

| | | | | |
|---|---|---|---|---|
| 1,975,162 | A | | 10/1934 | Layne |
| 2,342,913 | A | | 2/1944 | Williams et al. |
| 2,344,909 | A | | 3/1944 | Williams et al. |
| 3,005,507 | A | | 10/1961 | Clark, Jr. et al. |
| 3,486,558 | A | | 12/1969 | Maxwell |
| 3,627,046 | A | | 12/1971 | Miller et al. |
| 3,865,188 | A | | 2/1975 | Doggett et al. |
| 4,103,741 | A | * | 8/1978 | Daigle ..... 166/147 |
| 4,418,754 | A | | 12/1983 | Stepp |
| 4,428,428 | A | | 1/1984 | Smyrl et al. |
| 4,494,608 | A | | 1/1985 | Williams et al. |
| 4,553,595 | A | | 11/1985 | Huang et al. |
| 4,558,742 | A | | 12/1985 | Huang et al. |
| 4,627,488 | A | | 12/1986 | Szarka |
| 4,646,839 | A | | 3/1987 | Rickey |
| 4,858,690 | A | | 8/1989 | Rebardi et al. |
| 4,886,432 | A | | 12/1989 | Kimberlin |
| 4,932,474 | A | | 6/1990 | Schroeder, Jr. et al. |
| 4,945,991 | A | | 8/1990 | Jones |

(Continued)

FOREIGN PATENT DOCUMENTS

| | | |
|---|---|---|
| EP | 0 431 162 | 6/1991 |

(Continued)

OTHER PUBLICATIONS

Restarick, H.L. of Otis Engineering Corp.; "Mechanical Fluid-Loss Control Systems Used During Sand Control Operations"; 1992; pp. 21-36.

(Continued)

*Primary Examiner*—David Bagnell
*Assistant Examiner*—Giovanna M. Collins
(74) *Attorney, Agent, or Firm*—Lawrence R. Youst

(57) ABSTRACT

A fluid flow control device (60) for use in a wellbore to control the inflow of production fluids comprises a sand control screen (62) having a base pipe (64) with a first set of openings (66) that allows the production fluids to flow therethrough and a sleeve (74) coaxially disposed adjacent to the base pipe (64). The sleeve (74) has a second set of openings (76) that allows the production fluids to flow therethrough. The sleeve (74) is selectively positionable relative to the base pipe (64) such that a pressure drop in the production fluids is selectively controllable by adjusting an alignment of the first set of openings (66) relative to the second set of openings (76).

60 Claims, 6 Drawing Sheets

U.S. PATENT DOCUMENTS 5,082,052 A 1/1992 Jones et al.
5,111,883 A 5/1992 Savery
5,113,935 A 5/1992 Jones et al.
5,161,613 A 11/1992 Jones
5,161,618 A 11/1992 Jones et al.
5,228,526 A 7/1993 Vshivkov et al.
5,332,039 A 7/1994 Primeaux et al.
5,333,688 A 8/1994 Jones et al.
5,343,949 A 9/1994 Ross et al.
5,355,953 A 10/1994 Shy et al.
5,355,956 A 10/1994 Restarick
5,386,874 A 2/1995 Laramay et al.
5,390,966 A 2/1995 Cox et al.
5,419,394 A 5/1995 Jones
5,435,393 A 7/1995 Brekke et al.
5,443,117 A 8/1995 Ross
5,476,143 A 12/1995 Sparlin et al.
5,515,915 A 5/1996 Jones et al.
5,588,487 A 12/1996 Bryant
5,636,691 A 6/1997 Hendrickson et al.
5,676,208 A 10/1997 Finley
5,699,860 A 12/1997 Grundmann
5,722,490 A 3/1998 Ebinger
5,730,223 A 3/1998 Restarick
5,755,286 A 5/1998 Ebinger
5,842,516 A 12/1998 Jones
5,848,645 A 12/1998 Jones
5,865,251 A 2/1999 Rebardi et al.
5,868,200 A 2/1999 Bryant et al.
5,890,533 A 4/1999 Jones
5,896,928 A 4/1999 Coon
5,906,238 A 5/1999 Carmody et al.
5,921,318 A 7/1999 Ross
5,934,376 A 8/1999 Nguyen et al.
5,988,285 A 11/1999 Tucker et al.
6,003,600 A 12/1999 Nguyen et al.
6,047,773 A 4/2000 Zeltmann et al.
6,059,032 A 5/2000 Jones
6,112,815 A 9/2000 Bøe
6,112,817 A 9/2000 Voll et al.
6,116,343 A 9/2000 Van Petegem et al.
6,125,933 A 10/2000 Ross
6,220,345 B1 4/2001 Jones et al.
6,227,303 B1 5/2001 Jones
6,230,803 B1 5/2001 Morton et al.
6,276,458 B1 8/2001 Malone et al.
6,286,594 B1 9/2001 French
6,302,208 B1 10/2001 Walker et al.
6,325,150 B1 12/2001 Rayssiguier
6,343,651 B1 2/2002 Bixenman
6,371,208 B1 4/2002 Norman et al.
6,371,210 B1 * 4/2002 Bode et al. ..... 166/370
6,397,950 B1 6/2002 Streich et al.
6,405,800 B1 6/2002 Walker et al.
6,446,729 B1 9/2002 Bixenman et al.
6,450,263 B1 9/2002 Schwendemann
6,457,518 B1 10/2002 Castano-Mears et al.
6,464,007 B1 10/2002 Jones
6,478,091 B1 11/2002 Gano
6,488,082 B1 12/2002 Echols et al.
6,494,261 B1 12/2002 Pahmiyer
6,494,265 B1 * 12/2002 Wilson et al. ..... 166/332.1
6,540,022 B1 4/2003 Dusterhoft et al.
6,543,538 B1 4/2003 Tolman et al.
6,547,011 B1 4/2003 Kilgore
6,557,634 B1 5/2003 Hailey, Jr. et al.
6,622,794 B1 9/2003 Zisk, Jr.
6,644,412 B1 * 11/2003 Bode et al. ..... 166/373
6,681,854 B1 1/2004 Danos
6,695,054 B1 2/2004 Johnson et al.
6,719,051 B1 4/2004 Hailey, Jr. et al.
6,745,843 B1 * 6/2004 Johnson et al. ..... 166/386
6,786,285 B1 9/2004 Johnson et al.
6,805,202 B1 10/2004 Gillespie et al.
6,857,476 B1 2/2005 Richards
6,886,634 B1 5/2005 Richards
6,899,176 B1 5/2005 Hailey, Jr. et al.
2002/0074119 A1 6/2002 Bixenmann et al.
2002/0092649 A1 7/2002 Bixenman et al.
2002/0096329 A1 7/2002 Coon et al.
2002/0125006 A1 9/2002 Hailey, Jr. et al.
2002/0125008 A1 9/2002 Wetzel et al.
2002/0157837 A1 10/2002 Bode et al.
2002/0174981 A1 11/2002 Den Boer et al.
2002/0189815 A1 12/2002 Johnson et al.
2003/0000701 A1 1/2003 Dusterhoft et al.
2003/0000875 A1 1/2003 Echols et al.
2003/0056947 A1 3/2003 Cameron
2003/0056948 A1 3/2003 Cameron
2003/0075324 A1 4/2003 Dusterhoft et al.
2003/0089496 A1 5/2003 Price-Smith et al.
2003/0141061 A1 7/2003 Hailey, Jr. et al.
2003/0141062 A1 7/2003 Cowan et al.
2003/0188871 A1 10/2003 Dusterhoft et al.
2004/0020832 A1 2/2004 Richards et al.
2004/0035578 A1 2/2004 Ross et al.
2004/0035591 A1 2/2004 Echols
2004/0173350 A1 9/2004 Wetzel et al.

FOREIGN PATENT DOCUMENTS

EP 0 617 195 9/1994
EP 1 132 571 A1 9/2001
EP 0 955 447 3/2004
GB 2371319 A 1/2002
GB 2 371 578 7/2002
GB 2 381 021 A 4/2003
GB 2 381 811 A 5/2003
WO WO 99/12630 3/1999
WO WO 00/61913 10/2000
WO WO 01/14691 3/2001
WO WO 01/42620 6/2001
WO WO 01/44619 6/2001
WO WO 01/49970 7/2001
WO WO 02/10554 A1 2/2002
WO WO 02/055842 A1 7/2002
WO WO 02/057594 A1 7/2002

OTHER PUBLICATIONS

"Sand Control Screens"; Halliburton Energy Services, Inc; 1994; 4 pages.

Ebinger, Charles D. of Ely & Associates Inc.; "Frac Pack Technology Still Evolving"; Oil & Gass Journal, Oct. 23, 1995; pp. 60-70.

Hailey, Travis et al. of Halliburton Energy Services, Inc.; "Screenless Single Trip Multizone Sand Control Tool System Saves Rig Time"; Society of Petroleum Engineers Inc.; Feb. 2000; pp. 1-11.

"Caps Sand Control Service for Horizontal Completions Improves Gravel Pack Reliability and Increases Production Potential from Horizontal Completions"; Halliburton Energy Services, Inc.; Aug. 2000; 2 pages.

"CAPS Concentric Annular Packing Service for Sand Control"; Halliburton Energy Services Inc.; Aug. 2000; 4 pages.

Saldungaray, Pedro M. et al. of Schlumberger; "Simultaneous Gravel Packing and Filter Cake Removal in Horizontal Wells Applying Shunt Tubes and Novel Carrier and Breaker Fluid"; Mar. 2001; pp. 1-6.

"Quantum Zonal Isolation Tool"; pp. 12-13 of Sand Face Competions Catalog.

"Absolute Isolation System (ASI) Components"; Halliburton Energy Services, Inc.; pp. 5-28 of Downhole Sand Control Components.
"OSCA HPR-ISO System"; Technical Bulletin; 1 page.
"OSCA The ISO System"; Technical Bulletin; 1 page.
U.S. Appl. No. 10/525,621, Unpublished, Brezinski et al.
"OSCA Screen Communication System"; 1 page; Technical Bulletin.
"OSCA Pressure Actuated Circulating Valve"; 1 page; Technical Bulletin.

* cited by examiner 10
12
22
20
24
26
18
30
28
36
44
56
54
34
52
16
42
40
50
48
32
46
14
38

FLUID FLOW CONTROL DEVICE AND METHOD FOR USE OF SAME

TECHNICAL FIELD OF THE INVENTION

This invention relates, in general, to controlling the inflow of formation fluids from a well that traverses a hydrocarbon bearing subterranean formation and, in particular, to a fluid flow control device for controlling the inflow of formation fluids and a method for use of the same.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string is cemented within the wellbore before the next section of the wellbore is drilled.

Once this well construction process is finished, the completion process may begin. The completion process comprises numerous steps including creating hydraulic openings or perforations through the production casing string, the cement and a short distance into the desired formation or formations so that production fluids may enter the interior of the wellbore. The completion process may also include installing a production tubing string within the well casing which is used to produce the well by providing the conduit for formation fluids to travel from the formation depth to the surface.

To selectively permit and prevent fluid flow into the production tubing string, it is common practice to install one or more sliding sleeve type flow control devices within the tubing string. Typical sliding sleeve type flow control devices comprise a generally tubular body portion having side wall inlet openings formed therein and a tubular flow control sleeve coaxially and slidably disposed within the body portion. The sleeve is operable for axial movement relative to the body portion between a closed position, in which the sleeve blocks the body inlet ports, and an open position, in which the sleeve uncovers the ports to permit fluid to flow inwardly therethrough into the interior of the body and thus into the interior of the production tubing string. The sliding sleeves thus function as movable valve elements operable to selectively permit and prevent fluid inflow. Generally, cylindrical shifter tools, coaxially lowered into the interior of the tubing string, are utilized to shift selected ones of the sliding sleeves from their closed positions to their open positions, or vice versa, to provide subsurface flow control in the well.

It has been found, however, that typical sliding sleeve type flow control devices are not suitable in completions requiring sand control as they are not compatible with typical sand control screens. Recently, a device has been proposed that combines sand control and fluid flow control, which was disclosed in U.S. Pat. No. 5,896,928. Specifically, the device includes a generally tubular body for placement into the wellbore. The tubular body has a sand control screen at an outer surface for preventing sand from entering into tubular body. After the fluid flows through the sand control screen it must pass through a labyrinth. A slidable sleeve on the labyrinth controls the fluid velocity therethrough. The slidable sleeve is moved by a remotely and electrically-operated device placed in the tubular body. The fluid leaving the labyrinth passes to the tubing string for carrying the fluid to the surface.

It has been found, however, the labyrinth type flow control devices are difficult and expensive to manufacture and can be unreliable under certain inflow conditions. Accordingly, need has arisen for a fluid flow control device for controlling the inflow of formation fluids in a completion requiring sand control. A need has also arisen for such a fluid flow control device that is not difficult or expensive to manufacture. Further, a need has arisen for such a fluid flow control device that is reliable in a variety of flow conditions.

SUMMARY OF THE INVENTION

The present invention disclosed herein comprises a fluid flow control device for controlling the inflow of formation fluids in completions requiring sand control and a method for use of the same. The fluid flow control device of the present invention is not difficult or expensive to manufacture. In addition, the fluid flow control device of the present invention is reliable in a variety of flow conditions.

The fluid flow control device of the present invention comprises a sand control screen having a base pipe with a set of openings that allows the production fluids to flow therethrough. The fluid flow control device also includes a sleeve coaxially disposed adjacent to the base pipe. The sleeve also has a set of openings that allows the production fluids to flow therethrough. The sleeve is selectively positionable relatively to the base pipe and may form an annulus therebetween such that the pressure drop in the production fluids flowing therethrough is selectively controllable by adjusting the alignment of the set of openings of the sleeve relative to the set of openings of the base pipe.

In one embodiment of the fluid flow control device of the present invention, the sleeve is axially selectively positionable relative to the base pipe. In another embodiment, the sleeve is rotatably selectively positionable relative to the base pipe. In yet another embodiment, the sleeve is axially and rotatably selectively positionable relative to the base pipe. In one embodiment of the fluid flow control device of the present invention, the sleeve is coaxially positioned interiorly relative to the base pipe. In another embodiment of the fluid flow control device of the present invention, the sleeve is coaxially positioned exteriorly relative to the base pipe.

In one embodiment of the fluid flow control device of the present invention, the set of openings of the sleeve has substantially the same geometry as the set of openings of the base pipe. In another embodiment, the set of openings of the sleeve has a different geometry than the set of openings of the base pipe. In one embodiment of the fluid flow control device of the present invention, the openings of the sleeve have substantially the same shape as the openings of the base pipe. In another embodiment, the openings of the sleeve have a different shape than the openings of the base pipe.

The fluid flow control device of the present invention has a fully open position wherein the pressure drop in the production fluids traveling through the set of openings of the sleeve, the annulus between the sleeve and the base pipe and the set of openings of the base pipe is at a minimum. In addition, most embodiments of the fluid flow control device of the present invention have partially open or choking positions wherein the pressure drop in the production fluids is increased. Further, some embodiments of the fluid flow control device of the present invention have a fully closed position wherein the production fluids are prevented from traveling therethrough.

The fluid flow control device of the present invention may be operated between its fully open position, its choking positions and its fully closed position using a variety of techniques such as using a mechanical shifting tool, using hydraulic pressure, using an electrically operated device or the like. In addition, downhole pressure sensors positioned exteriorly and interiorly of the fluid flow control device may be used to determine the pressure drop in the production fluids. Such pressure readings may be used by a downhole control circuit to automatically adjust the position of the sleeve relative to the base pipe to control the pressure drop in the production fluids. Other types of sensors may also be used in conjunction with the fluid flow control device of the present invention such as temperature sensors and fluid composition sensors that may be used to determine the constituents of the production fluids including, for example, the oil, gas, water, solids and fines content of the fluid as well as, for example, the API gravity of the fluid.

In another aspect of the present invention a method for controlling the inflow of production fluids comprises providing a production conduit including a sand control screen having a base pipe with a first set of openings and a sleeve coaxially disposed adjacent to the base pipe having a second set of openings, installing the production conduit within the wellbore, producing the production fluids into the production conduit through the first set of openings of the base pipe and the second set of openings of the sleeve and selectively adjusting the sleeve relative to the base pipe such that the pressure drop in the production fluids is controlled by adjusting the alignment of the first set of openings relative to the second set of openings.

The present invention also comprises a fluid flow control device that includes a tubular member having at least one fluid passageway in a sidewall section thereof. A sand control screen assembly is positioned exteriorly around the tubular member. The sand control screen assembly has a filter medium section that defines a first annular region with the tubular member and a housing section that defines a second annular region with the tubular member. A sleeve is slidably positioned within the second annular region. The sleeve has an open position wherein fluid communication is permitted between the second annular region and the fluid passageway and a closed position wherein fluid communication is prevented between the second annular region and the fluid passageway.

The fluid flow control device also includes a hydraulic control line that extends from a surface location to the sand control screen assembly. The hydraulic control line has a first section with a terminus that is selectively in fluid communication with the sleeve to operate the sleeve from the open position to the closed position. A eutectic valve is positioned within the housing section to selectively prevent and permit fluid communication between the first section of the hydraulic control line and the sleeve. The hydraulic control line also has a second section that passes through the first annular region and extends downhole of the sand control screen assembly.

The fluid flow control device has a sensor that may be positioned on the housing section of the sand control screen assembly to sense at least one downhole parameter such as temperature, pressure, fluid composition or the like. An energy conductor that extends from the surface and passes through the sand control screen assembly is in communication with the eutectic valve and the sensor. In operation, energy is supplied to the eutectic valve in response to one of the sensed downhole parameters, which melts the eutectic valve and establishes fluid communication between the first section of the hydraulic control line and the sleeve, thereby operating the sleeve from the open position to the closed position.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
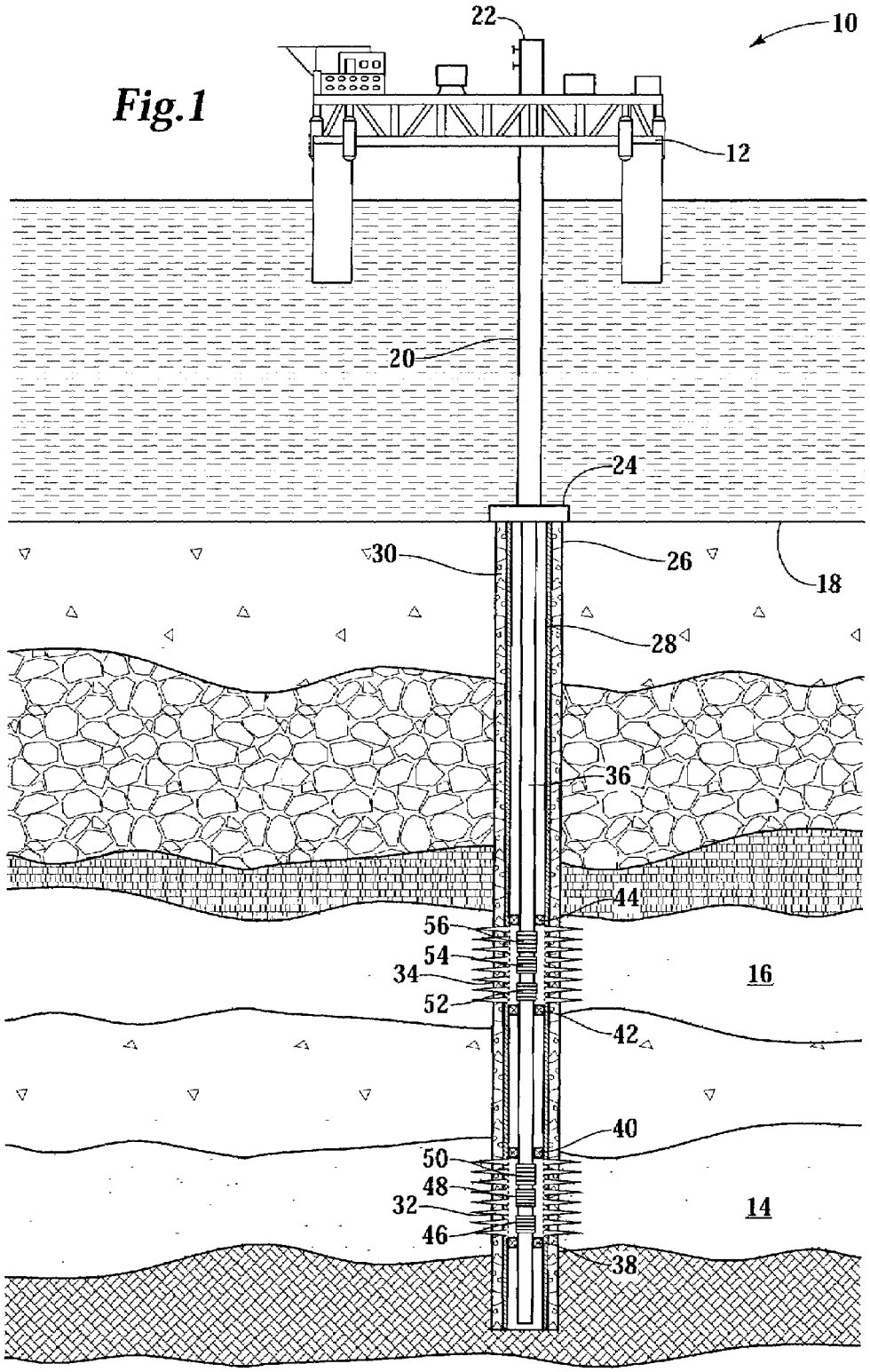
FIG. 1 is a schematic illustration of an offshore oil and gas platform operating a plurality of fluid flow control devices according to the present invention.

Referring initially to FIG. 1, an offshore oil and gas platform operating a plurality of fluid flow control devices is schematically illustrated and generally designated 10. A semi-submersible platform 12 is centered over submerged oil and gas formations 14, 16 located below sea floor 18. A subsea conduit 20 extends from a wellhead installation 22 to a subsea installation 24. A wellbore 26 extends through the various earth strata including formations 14, 16. A casing string 28 is cemented within wellbore 26 by cement 30. Casing string 28 includes perforations 32 and perforations 34 that respectively allow formation fluids from formations 14, 16 to enter the interior of casing string 28.

Positioned within casing string 28 and extending from wellhead installation 22 is a tubing string 36. Tubing string 36 provides a conduit for formation fluids to travel from formations 14, 16 to the surface. A pair of packers 38, 40 provide a fluid seal between tubing string 36 and casing string 28 and define a production interval adjacent to formation 14. Likewise, packers 42, 44 provide a fluid seal between tubing string 36 and casing string 28 and define a production interval adjacent to formation 16.

Positioned within tubing string 36 in the production interval adjacent to formation 14 are fluid flow control devices 46, 48 and 50. Likewise, positioned within tubing string 36 within the production interval adjacent to formation 16 are fluid flow control devices 52, 54 and 56. As explained in greater detail below, each of the fluid flow control devices 46–56 provides not only fluid flow control capability but also sand control capability.

In the illustrated embodiment, there are three fluid flow control devices 46, 48, 50 associated with formation 14 and three fluid control devices 52, 54, 56 associated with formation 16. Accordingly, the inflow of fluid from formation 14 and formation 16 may be controlled. For example, if the reservoir pressure of formation 14 is significantly higher than the reservoir pressure of formation 16, fluid flow control devices 46, 48, 50 may be used to choke the fluid flow from formation 14 to a greater extent than fluid flow control devices 52, 54, 56 will choke the fluid flow from formation 16. In addition, the fluid flow control devices of the present invention are independently controllable within each production interval. For example, certain ones of fluid flow control devices 46, 48, 50 may be used to choke or even close off certain sections of the production interval adjacent to formation 14 to prevent the production of water or other undesirable fluids. Similarly, one or all of the fluid flow control devices associated with a particular production interval may be adjusted over time as the adjacent formation becomes depleted or as downhole equipment experiences wear.

It should be understood by those skilled in the art that even though FIG. 1 has depicted three fluid flow control devices associated with each production interval, any number of fluid flow control devices either greater than or less than three may alternatively be used without departing from the principles of the present invention. Also, even though FIG. 1 has depicted a vertical wellbore, the fluid flow control devices of the present invention are equally well suited for use in wellbores having other directional configuration such as incline wellbores, deviated wellbores or horizontal wellbores.

It should be understood by those skilled in the art that even though FIG. 1 has depicted an offshore production operation, the fluid flow control devices of the present invention are equally well suited for onshore operations. Also, even though FIG. 1 has depicted a cased wellbore, the fluid flow control devices of the present invention are equally well suited for use in open hole completions.

Figure 2:
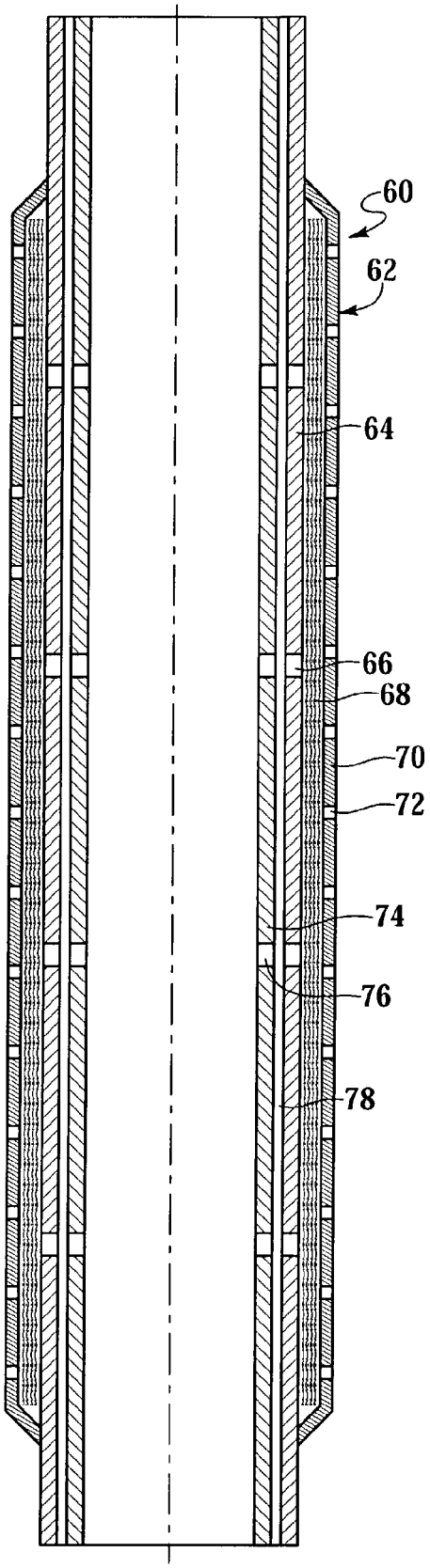
FIG. 2 is a half sectional view of a fluid flow control device according to the present invention positioned in its fully open position.

Referring next to FIG. 2, a fluid flow control device of the present invention is depicted and generally designated 60. Fluid flow control device 60 includes a sand control screen assembly 62. Sand control assembly 62 includes a base pipe 64 that has a plurality of openings 66 that allow the flow of production fluids into the production tubing. Even though openings 66 are depicted as round openings, it should be understood by those skilled in the art that openings of other configurations may alternatively be used and are considered within the scope of the present invention. For example, openings 66 could alternatively have a non circular shape such as an oval shape, a square shape, a rectangular shape or other similar shapes. Accordingly, the term openings as used herein is intended to encompass any type of discontinuity in base pipe 64 that allows for the flow of fluids therethrough including, but not limited to, perforations, holes and slots of any configuration that are presently known in the art or subsequently discovered. In addition, the exact number and size of opening 66 are not critical to the present invention, so long as sufficient area is provided for fluid production and the integrity of base pipe 64 is maintained. Openings 66 form a particular hole pattern in base pipe 64, the importance of which will be explained in more detail below.

Positioned around base pipe 64 is a filter medium 68. In the illustrated embodiment, filter medium 68 is a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough. Disposed around filter medium 68 is an outer shroud 70. Outer shroud 70 has a plurality of openings 72 which allow the flow of production fluids therethrough. The exact number, size and shape of openings 72 are not critical to the present invention, so long as sufficient area is provided for fluid production and the integrity of outer shroud 70 is maintained. Outer shroud 70 is designed to protect filter medium 68 during installation of fluid flow control device 60 into the wellbore as well as during production therethrough.

Positioned coaxially within base pipe 64 is a sleeve 74. Sleeve 74 is slidable coupled within base pipe 64 using detents such as collets or pins (not pictured) or other suitable devices that are well known to those skilled in the art. Sleeve 74 has a plurality of openings 76. As with openings 66 of base pipe 64, openings 76 of sleeve 74 may have any geometric configuration that is suitable for allowing the flow of production fluids therethrough. While the illustrated embodiment depicts openings 76 of sleeve 74 as having the same shape and size as openings 66 of base pipe 64, this relationship is not required by the present invention. For example, a fluid flow control device of the present invention could have slotted openings in sleeve 74 while having round openings in base pipe 64. In the illustrated embodiment, the hole pattern of openings 66 of base pipe 64 and openings 76 of sleeve 74 have substantially the same geometry. In addition, openings 66 of base pipe 64 and openings 76 of sleeve 74 are substantially aligned with one another. Accordingly, when fluid flow control device 60 is in the depicted configuration, the pressure drop in the production fluids traveling therethrough is at a minimum and fluid flow control device 60 is considered to be in its fully opened position. Specifically, to enter in the interior of fluid flow control device 60, the fluid must travel through an entry opening, one of the openings 66 of base pipe 64, an annulus 78 between base pipe 64 and sleeve 74 and an exit opening, one of the openings 76 of sleeve 74. As openings 66 of base pipe 64 and openings 76 of sleeve 74 are substantially aligned with one another, the distance the fluid is required to flow in annulus 78 is at a minimum.

Figure 3:
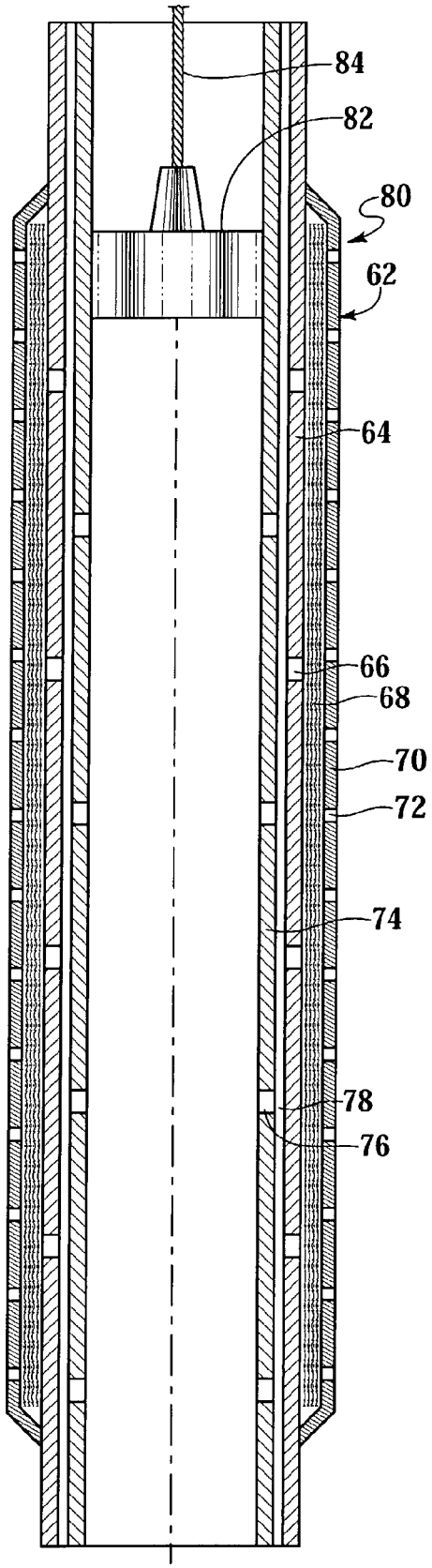
FIG. 3 is a half sectional view of a fluid flow control device according to the present invention positioned in a choking position.

Referring now to FIG. 3, therein is depicted a fluid flow control device of the present invention that is generally designated 80. The construction of fluid flow control device 80 is substantially identical to the construction of fluid flow control device 60 of FIG. 2. Fluid flow control device 80 is operated using a mechanical shifter 82 that may be carried downhole on a wireline 84. To allow shifter tool 84 to interact with sleeve 74, the interior side surfaces of sleeve 74 may have formed therein a longitudinally spaced series of annular, traversed notches, that receive a key set carried on mechanical shifter 82. Once mechanical shifter 82 is received by sleeve 74, sleeve 74 may be slidably shifted in the axial direction as can be seen by comparing the position of sleeve 74 relative to base pipe 64 in FIGS. 2 and 3.

In the illustrated embodiment, sleeve 74 has been axially repositioned to increase the pressure drop experienced by production fluids traveling through annulus 78. Specifically, as the set of openings 66 of base pipe 64 and the set of openings 76 of sleeve 74 have substantially the same hole pattern, when openings 66 and openings 76 are axially misaligned, the distance the formation fluids must travel within annulus 78 is increased, thereby increasing the pressure drop in the formation fluids. The amount of this pressure drop or choking is determined based upon a number of factors including the extent of the misalignment of openings 66 relative to openings 76, the thickness of annulus 78, the viscosity of the formation fluids and the like. In addition, the surface characteristics of either the exterior of sleeve 74 or the interior of base pipe 64 or both may be configured to further control the pressure drop. For example, grooves, channels, knurling, other turbulizing surfaces or the like may be added to one or both of the surfaces to increase the turbulence in the fluid flow thereby increasing the pressure drop across a given distance. Accordingly, once fluid flow control device 80 is installed downhole, the desired amount of pressure drop may be obtained by selectively misaligning openings 66 relative to openings 76 by axially shifting sleeve 74 relative to base pipe 64. Also, it should be noted that sensors, such as position sensors, pressure sensors, temperature sensors, fluid composition sensors and the like may be used in conjunction with mechanical shifter 82 to determined the desired extent of the misaligning of openings 66 relative to openings 76, as explained in greater detail below.

Figure 4:
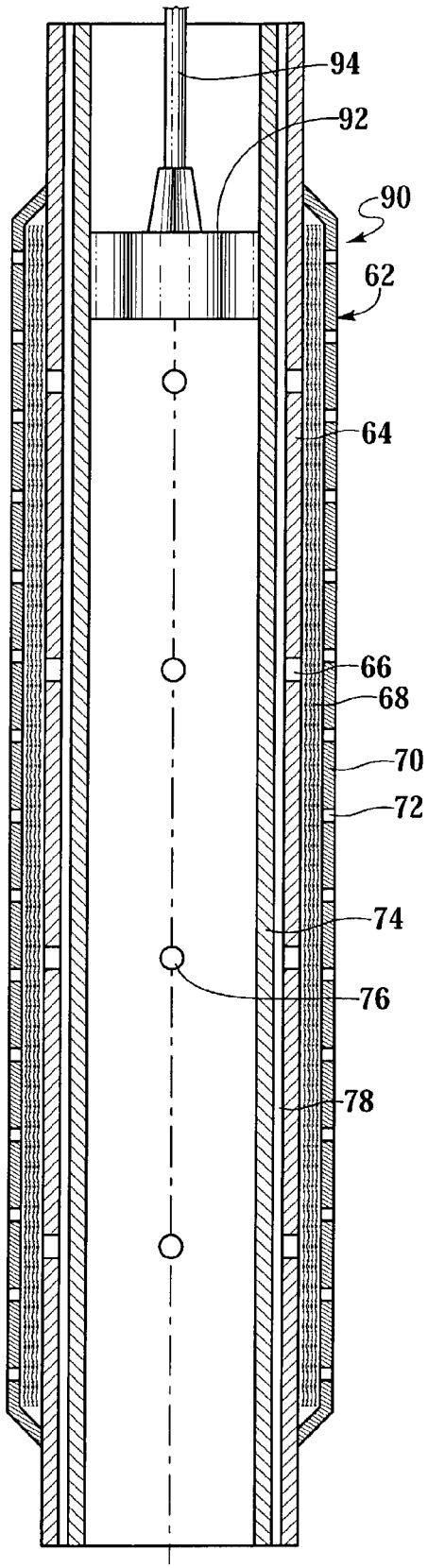
FIG. 4 is a half sectional view of a fluid flow control device according to the present invention positioned in a choking position.

Referring next to FIG. 4, therein is depicted a fluid flow control device of the present invention that is generally designated 90. Fluid flow control device 90 is constructed in a manner substantially identical to fluid flow control device 60 of FIG. 2. In the illustrated embodiment, fluid flow control device 90 is operated by an electromechanical shifter 92 that is run downhole on an electric line 94. Electromechanical shifter 94 may be received within sleeve 74 in a manner similar to that described above with reference to mechanical shifter 82 of FIG. 3. Once in place, electromechanical shifter 92 may be energized via electric line 94 such that sleeve 74 may be rotatably shifted relative to base pipe 64.

In the illustrated embodiment, sleeve 74 has been rotated ninety degrees relative to base pipe 64. This rotation increases the distance between openings 76 of sleeve 74 and openings 66 of base pipe 64. Accordingly, the formation fluid being produced into fluid flow control device 90 must travel an increased distance in annulus 78 relative to the position shown in FIG. 2. This increased distance equates to an increased pressure drop in the formation fluids. The desired amount of pressure drop may be achieved by selecting the amount of circumferential misalignment between openings 76 of sleeve 74 and openings 66 of base pipe 64. Also, it should be noted that sensors, such as position sensors, pressure sensors, temperature sensors, fluid composition sensors and the like may be used in conjunction with electromechanical shifter 92, these sensors may be permanently disposed downhole or may be carried downhole with the electromechanical shifter 92.

Figure 5:
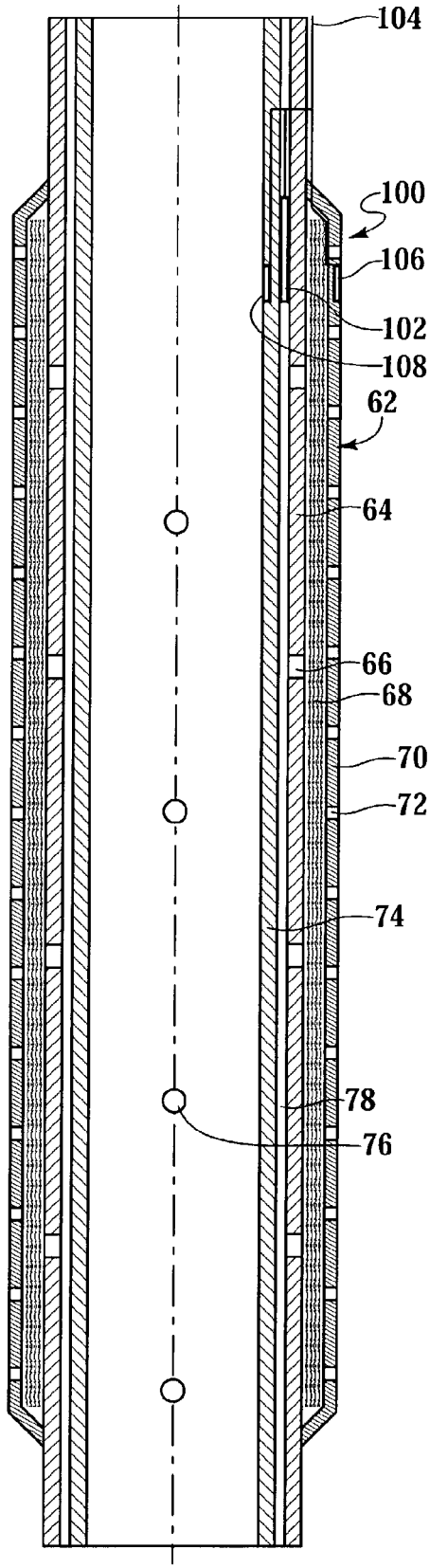
FIG. 5 is a half sectional view of a fluid flow control device according to the present invention positioned in a choking position.

Referring next to FIG. 5, therein is depicted a fluid flow control device of the present invention that is generally designated 100. Fluid flow control device 100 is constructed in substantially the same manner as fluid flow control device 60 of FIG. 2. Fluid flow control device 100 is operated using a downhole electrical motor 102 that is positioned within annulus 78 between sleeve 74 and base pipe 64. Downhole electrical motor 102 receives power from energy conductors 104 that may extend to the surface or may extend to a downhole electrical power source such as a battery pack or a downhole electrical generator. Downhole electrical motor 102 includes a control circuit that commands downhole electrical motor 102 to shift sleeve 74 relative to base pipe 64 when it is desirable to adjust the pressure drop in the production fluids being produced therethrough. A pair of pressure sensors 106, 108 are used to monitor the pressure on the exterior of fluid flow control device 100 and the pressure on the interior of fluid flow control device 100, respectively.

The pressure information may be carried to the surface via energy conductors 104 where it may be processed then command signals may be returned to the control circuit of downhole electrical motor 102 via energy conductors 104 to initiate the operation of downhole electrical motor 102. Alternatively, the pressure information may be sent directly to the control circuit of downhole electrical motor 102 from pressure sensors 106, 108 to initiate operation of downhole electrical motor 102. Additionally, sleeve 74 may include a position sensor that identifies the relative position of sleeve 74 and base pipe 64 to further refine the operation of shifting sleeve 74. The position sensor may be powered by energy conductors 104 and may send signals to the surface or directly to the control circuit of downhole electric motor 102.

In the illustrated embodiment, downhole electrical motor 102 is operable to axially adjust the position of sleeve 74 relative to base pipe 64 and rotatably adjust the position of sleeve 74 relative to base pipe 64. By comparing FIGS. 2 and 5, it can be seen that sleeve 74 has been axially and rotatably adjusted relative to base pipe 64. Accordingly, the distance between openings 76 of sleeve 74 and openings 66 of base pipe 64 has been increased, which in turn increases the distance the production fluids must travel in annulus 78 resulting in an increase in the pressure drop in the production fluids. This embodiment of fluid flow control device 100 is particularly suitable for precision control of the pressure drop due to the interaction of pressure sensors 106, 108, the position sensor and the control circuit of downhole electrical motor 102.

Figure 6:
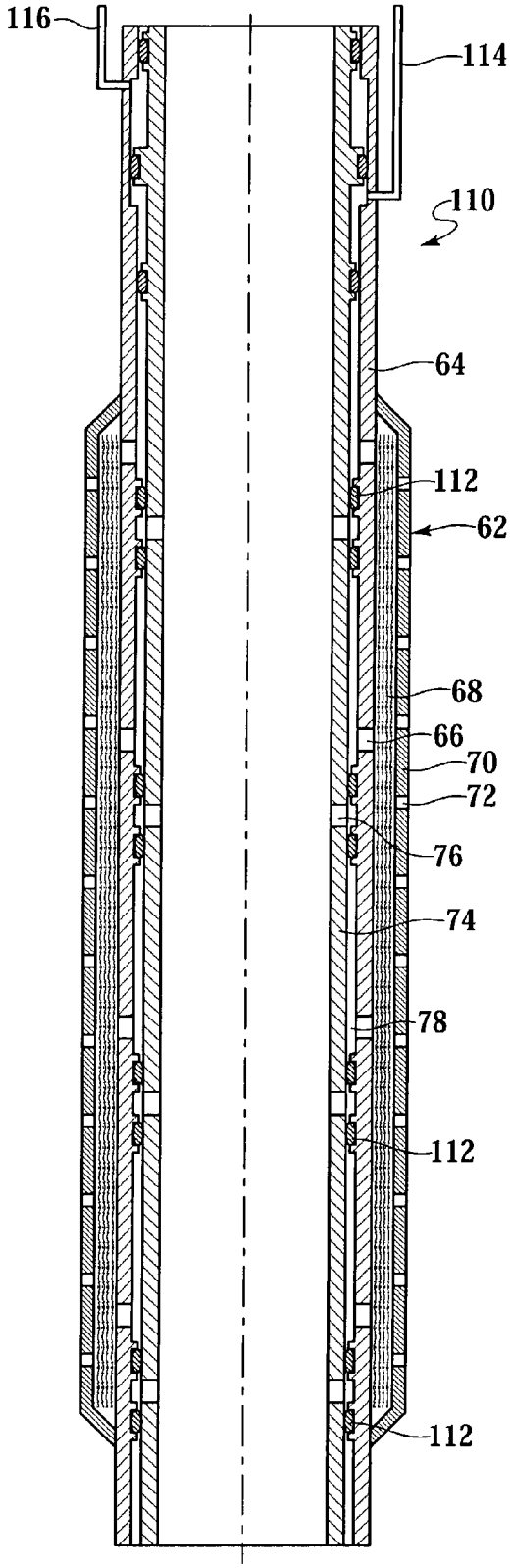
FIG. 6 is a half sectional view of a fluid flow control device according to the present invention positioned in its fully closed position.

Referring now to FIG. 6, therein is depicted another embodiment of a fluid flow control device of the present invention that is generally designated 110. Fluid flow control device 110 is constructed in substantially the same manner as fluid flow control device 60 of FIG. 2 with the exception that fluid flow control device 110 includes a plurality of seals 112 carried by base pipe 64. The operation of fluid flow control device 110 is hydraulically controlled in a conventional manner by increasing and decreasing the pressure within hydraulic control lines 114, 116 which allows sleeve 74 to axially shift relative base pipe 64. As described above, as openings 76 of sleeve 74 become misaligned with openings 66 of base pipe 64, the pressure drop in the formation fluids being produced therethrough increases. In the illustrated embodiment, however, when sleeve 74 is shifted to the illustrated position relative to base pipe 64, fluid production through fluid flow control device 110 is prevented as each of the openings 76 of sleeve 74 are positioned between a pair of seals 112. Accordingly, fluid flow control device 110 can be operated from a fully opened position (see FIG. 2) to a fully closed positioned as well as various choking positions therebetween.

Figure 7:
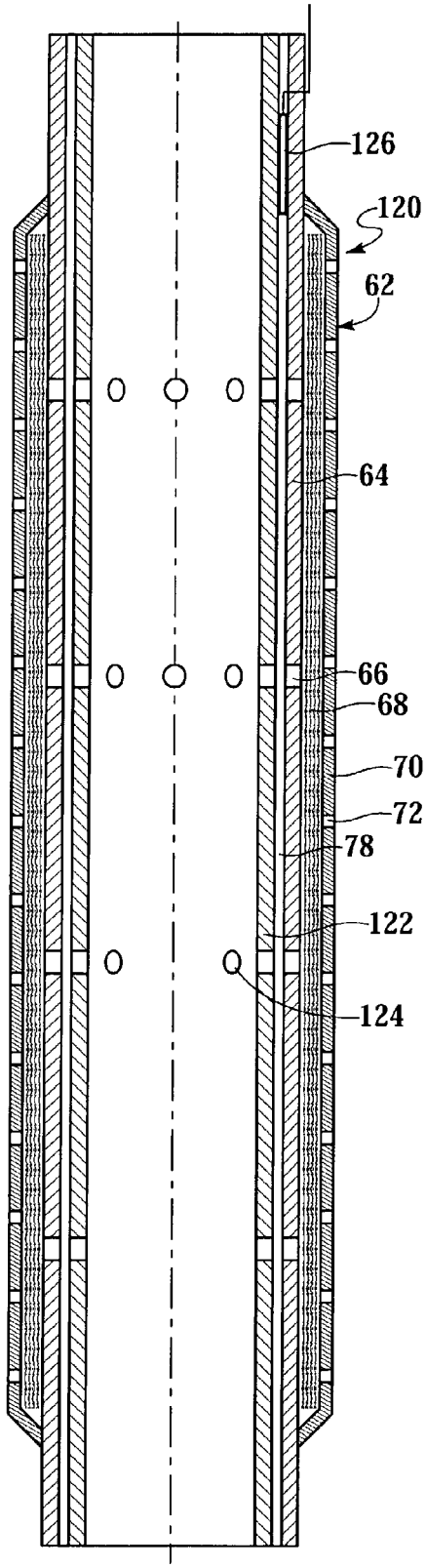
FIG. 7 is a half sectional view of a fluid flow control device according to the present invention positioned in its fully open position.

Referring next to FIG. 7, therein is depicted a fluid flow control device of the present invention that is generally designated 120. Fluid flow control device 120 is constructed in substantially the same manner as fluid flow control device 60 of FIG. 2, however, sleeve 74 as depicted in FIG. 2 has been replaced with sleeve 122. Sleeve 122 includes a plurality of openings 124 that form a hole pattern with a geometry that is different from the hole pattern of openings 66 of base pipe 64. Fluid flow control device 120 is operated using a downhole electrical motor 126 which is operable to rotatably shift sleeve 122 relative to base pipe 64. This rotation aligns the various columns of openings 124 of sleeve 122 with openings 66 of base pipe 64. In the illustrated configuration, each opening 66 of base pipe 64 is aligned with an opening 124 of sleeve 122. When sleeve 122 is rotated using downhole electrical motor 126, however, some of the openings 66 of base pipe 64 will no longer be aligned with an opening 124 of sleeve 122. Accordingly, the pressure drop in the production fluids is controlled by adjusting the relative alignment of openings 124 of sleeve 122 with openings 66 of base pipe 64.

Figure 8:
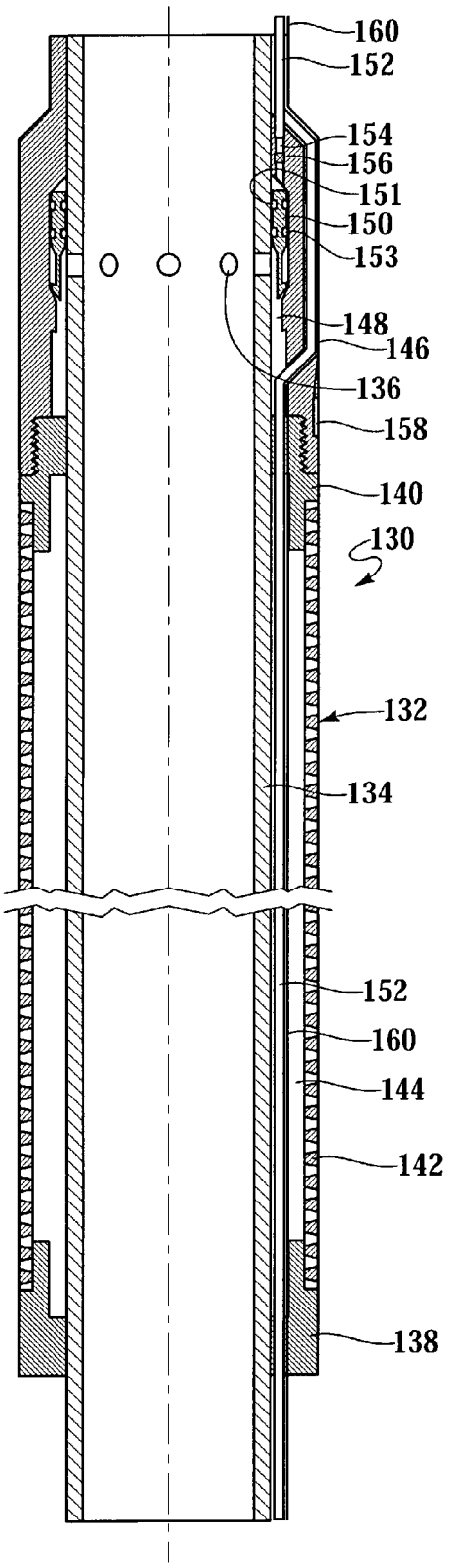
FIG. 8 is a half sectional view of a fluid flow control device according to the present invention positioned in its open position.

Referring now to FIG. 8, therein is depicted another embodiment of a fluid flow control device of the present invention that is generally designated 130. Fluid flow control device 130 includes a sand control screen assembly 132. Sand control screen assembly 132 includes a base pipe 134 that has a series of openings 136 that are circumferentially spaced therearound. Sand control screen assembly 132 has a pair of screen connectors 138, 140 that attach a sand control screen 142 to base pipe 134. Screen connectors 138, 140 may be attached to base pipe 134 by welding or other suitable technique. Sand control screen 142 may comprise a screen wire wrapped around a plurality of ribs to form turns having gaps therebetween which allow the flow of formation fluids therethrough but which block the flow of particulate matter therethrough. The number of turns and the size of the gaps between the turns are determined based upon the characteristics of the formation from which fluid is being produced and the size of the gravel to be used during a gravel packing operation, if any.

Screen connectors 138, 140 attach sand control screen 142 to base pipe 134 such that an annulus 144 is formed between sand control screen 142 and base pipe 134. It should be noted that centralizers or other support members may be disposed within annulus 144 to support sand control screen 142 and maintain the standoff between sand control screen 142 and base pipe 134. Coupled to the upper end of screen connector 140 is a housing member 146. Housing member 146 forms an annulus 148 with base pipe 134 adjacent to openings 136. Disposed within annulus 148 is a sliding sleeve 150 having a pair of seals 151 disposed on the interior side thereof to provide a seal against base pipe 134 and a pair of seals 153 disposed on the exterior side thereof to provide a seal against housing member 146.

Disposed exteriorly of base pipe 134 and extending from the surface is a hydraulic fluid conduit 152. One portion of hydraulic fluid conduit 152 extends into a fluid passageway 154 within housing member 146. Disposed within fluid passageway 154 is a valve 156, such as a eutectic valve. Another portion of hydraulic fluid conduit 152 extends into and through housing member 146 and screen connector 140 into annulus 144. This portion of hydraulic fluid conduit 152 extends through annulus 144 to exit sand control screen assembly 132 through screen connector 138.

Importantly, this portion of hydraulic fluid conduit 152 runs within a recess or channel in housing member 146 and on the inside of sand control screen 142, instead of the outside of sand control screen 142, which removes the need to band hydraulic fluid conduit 152 to the exterior of sand control screen 142 which would block the inflow of formation fluids through those portions of sand control screen 142 covered by the banding material. Also, this portion of hydraulic fluid conduit 152 is protected by having sand control screen 142 positioned exteriorly thereof. Alternatively, the channel on the exterior of housing member 146 could be extended along the exterior of sand control screen 142 such that hydraulic fluid conduit 152 could be positioned within the channel for protection. As can be seen in FIG. 8, hydraulic fluid conduit 152 is capable of providing operating fluid to fluid flow control device 130 and is also capable of providing operating fluid to other devices downhole of fluid flow control device 130 such as additional fluid flow control devices positioned further downhole.

A sensor 158 is positioned on the exterior of housing member 146. Sensor 158 may provide information relating to a variety of downhole parameters such as pressure, temperature, fluid composition or the like. Sensor 158 is in communication with the surface via energy conductors 160. Energy conductors 160 may provide power and communication capabilities to sensor 158 as well as to valve 156. In the case in which valve 156 is a eutectic valve and it is desirable to operate fluid flow control device 130 to the closed position, energy is conducted to valve 156 via energy conductors 160 to melt the eutectic material such that operating fluid from hydraulic fluid conduit 152 may be communicated to sliding sleeve 150. Energy conductors 160 also extend through fluid flow control device 130 in a manner similar to hydraulic fluid conduit 152 by passing through housing member 146, screen connector 140, annulus 144 and screen connector 138. Alternatively, instead of using sensor 158 to obtain information relating to downhole parameters, energy conductors 160 may include a fiber optic cable which may be used to obtain certain downhole parameters such as temperature and pressure at particular locations.

Figure 9:
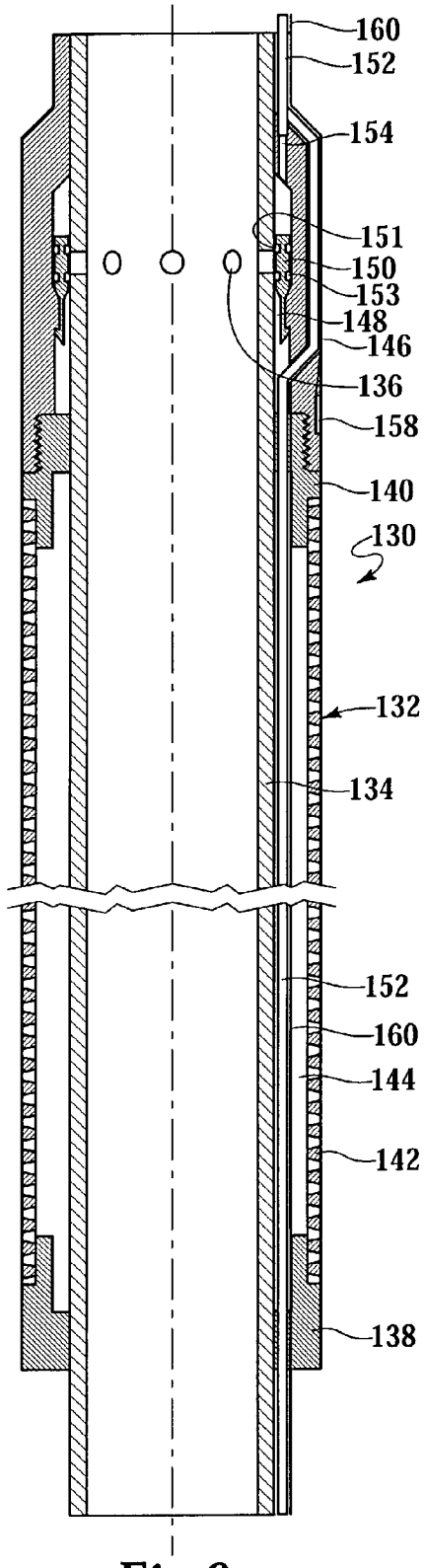
FIG. 9 is a half sectional view of a fluid flow control device according to the present invention positioned in its closed positions.

In operation and referring both to FIGS. 8 and 9, fluid flow control device 130 is used to filter particulate matter out of production fluids and control the flow of fluids into the tubing string. More specifically, when fluid flow control device 130 is in its open position as depicted in FIG. 8, formation fluids are produced through sand control screen 142 into annulus 144. These formation fluids then travel upwardly through screen connector 140 that has a plurality of axially extending openings allowing the formation fluids to pass into annulus 148 above screen connector 140. From annulus 148, fluid communication is allowed through openings 136 such that the formation fluids may travel to the surface via the tubing string.

If it is determined that production through fluid flow control device 130 should no longer continue, fluid flow control device 130 may be operated to its closed position as depicted in FIG. 9. For example, if sensor 158 has sensed that the formation fluids are being produced through fluid flow control device 130 contain an undesirable percentage of water, then a signal may be sent to the surface via energy conductors 160 indicating such a fluid composition. Thereafter, power may be sent to valve 156 via energy conductors 160 and through appropriate switching or addressing circuitry such that the eutectic material of valve 156 is melted, thereby allowing fluid communication through fluid passageway 154. Thereafter, operating fluid from hydraulic fluid conduit 152 may act on sliding sleeve 150 such that openings 136 of base pipe 134 are no longer in communication with annulus 148. Once in this configuration, fluid flow control device 130 no longer permits formation fluids to flow therethrough.

As described above, hydraulic fluid conduit 152 and energy conductors 160 pass through sand control screen assembly 132 such that similar operations may be conducted on fluid flow control devices or other devices that are positioned downhole of fluid flow control device 130.

Figure 10:
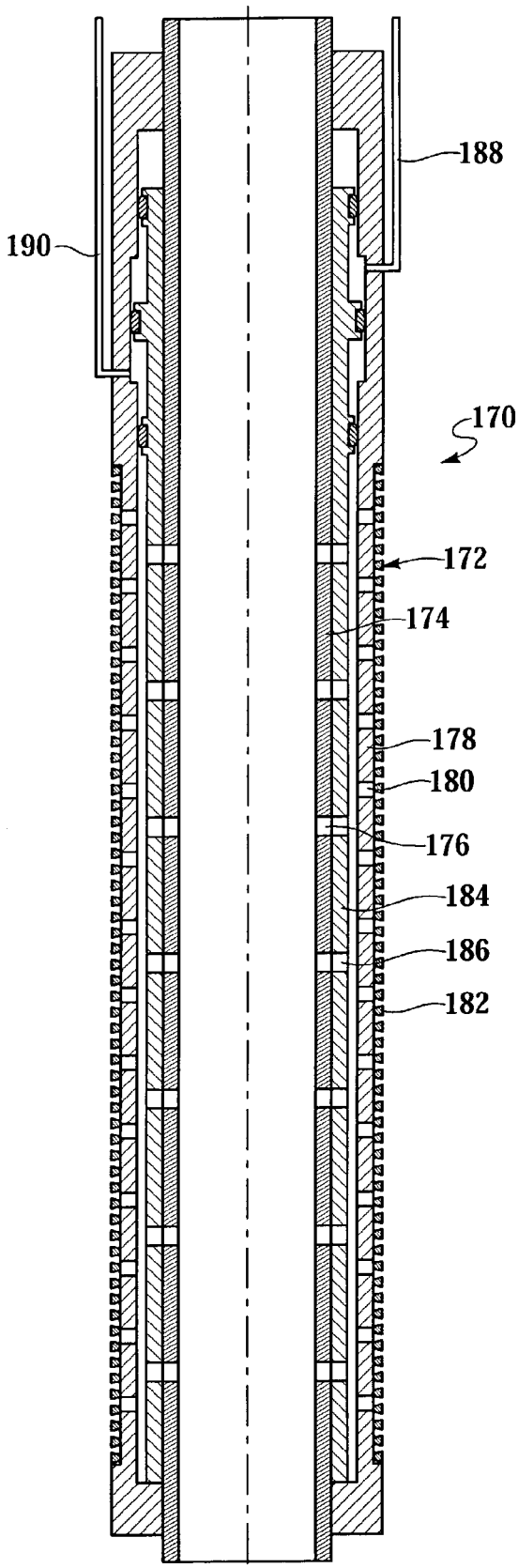
FIG. 10 is a half sectional view of a fluid flow control device according to the present invention having a sleeve positioned exteriorly of the base pipe and positioned in its open position.

Referring now to FIG. 10, therein is depicted another embodiment of a fluid flow control device of the present invention that is generally designated 170. Fluid flow control device 170 includes a sand control screen assembly 172. Sand control screen assembly 172 includes a base pipe 174 that has a series of openings 176. Sand control screen assembly 172 also has a screen support member 178 that is attached by welding or other suitable technique at opposite ends to base pipe 174 and has a series of openings 180. The filter media of sand control screen assembly 172 is depicted as a wire wrapped screen 182 such as that described above with reference to FIG. 8.

Unlike the previously disclosed fluid flow control devices, fluid flow control device 170 is constructed with a sleeve 184 coaxially positioned exteriorly of base pipe 174. Sleeve 184 has a plurality of openings 186 that have substantially the same geometry as openings 176 of base pipe 174. In the illustrated embodiment, sleeve 184 is closely received around base pipe 174 such that there is a friction fit therebetween. This friction fit can operate substantially as a seal to provide significant resistance to flow between sleeve 184 and base pipe 174 when openings 186 are not aligned with openings 176. Alternatively, an annulus may be formed between sleeve 184 and base pipe 174 operating substantially as annulus 78 discussed above. The operation of fluid flow control device 170 is hydraulically controlled in a conventional manner by increasing and decreasing the pressure within hydraulic control lines 188, 190 which allows sleeve 184 to axially shift relative base pipe 174.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A fluid flow control device for use in a wellbore to control the inflow of production fluids comprising:

a sand control screen having a base pipe with a first set of openings that allows the production fluids to flow therethrough; and a sleeve coaxially disposed adjacent to the base pipe forming an annulus therebetween, the sleeve having a second set of openings that allows the production fluids to flow therethrough, the sleeve selectively positionable relative to the base pipe such that a pressure drop in the production fluids is selectively controllable by adjusting an alignment of the first set of openings relative to the second set of openings, thereby adjusting the distance the production fluids must travel in the annulus which alters the pressure drop in the production fluids traveling within the annulus.

2. The fluid flow control device as recited in claim 1 wherein the sleeve is axially selectively positionable relative to the base pipe to adjust the alignment of the first set of openings relative to the second set of openings.

3. The fluid flow control device as recited in claim 1 wherein the sleeve is rotatably selectively positionable relative to the base pipe to adjust the alignment of the first set of openings relative to the second set of openings.

4. The fluid flow control device as recited in claim 1 wherein the sleeve is axially and rotatably selectively positionable relative to the base pipe to adjust the alignment of the first set of openings relative to the second set of openings.

5. The fluid flow control device as recited in claim 1 wherein the first set of openings has substantially the same geometry as the second set of openings.

6. The fluid flow control device as recited in claim 1 wherein the first set of openings has a different geometry than the second set of openings.

7. The fluid flow control device as recited in claim 1 wherein the fluid flow control device has a fully open position wherein the pressure drop in the production fluids traveling through the first set of openings and the second set of openings is at a minimum.

8. The fluid flow control device as recited in claim 1 wherein the sleeve is selectively positlonable relative to the base pipe using hydraulic pressure.

9. The fluid flow control device as recited in claim 1 wherein the fluid flow control device has a fully closed position wherein the flow of the production fluids therethrough is prevented.

10. The fluid flow control device as recited in claim 1 wherein the fluid flow control device is adjustable between fully opened and fully closed positions.

11. The fluid flow control device as recited in claim 1 wherein the sleeve is selectively positionable relative to the base pipe using a mechanical shifting tool.

12. The fluid flow control device as recited in claim 1 wherein the sleeve is selectively positionable relative to the base pipe using a mechanical shifting tool.

13. The fluid flow control device as recited in claim 1 further comprising a first pressure sensor exteriorly positioned relative to the fluid flow control device and a second pressure sensor interiorly positioned relative to the fluid flow control device that are used to determine the pressure drop in the production fluids.

14. The fluid flow control device as recited in claim 13 further comprising a control circuit that provides signals to control the relative position of the sleeve and the base pipe based upon the determined pressure drop in the production fluids.

15. The fluid flow control device as recited in claim 1 wherein the sleeve is coaxially disposed interiorly of the base pipe.

16. The fluid flow control device as recited in claim 1 wherein the sleeve is coaxially disposed exteriorly of the base pipe.

17. A method for controlling the inflow of production fluids into a production conduit within a wellbore comprising the steps of:

providing the production conduit including a sand control screen having a base pipe with a first set of openings and a sleeve coaxially disposed adjacent to the base pipe forming an annulus with the base pipe and having a second set of openings;

installing the production conduit within the wellbore;

producing the production fluids into the production conduit through the first set of openings of the base pipe, the annulus and the second set of openings of the sleeve; and selectively positioning the sleeve relative to the base pipe such that a pressure drop in the production fluids is controlled by adjusting the alignment of the first set of openings relative to the second set of openings, thereby adjusting the distance the production fluids must travel in the annulus which alters the pressure drop in the production fluids traveling within the annulus.

18. The method as recited in claim 17 wherein the step of selectively positioning the sleeve relative to the base pipe further comprises axially adjusting the sleeve relative to the base pipe.

19. The method as recited in claim 17 wherein the step of selectively positioning the sleeve relative to the base pipe further comprises rotatably adjusting the sleeve relative to the base pipe.

20. The method as recited in claim 17 wherein the step of selectively positioning the sleeve relative to the base pipe further comprises axially and rotatably adjusting the sleeve relative to the base pipe.

21. The method as recited in claim 17 wherein the step of selectively positioning the sleeve relative to the base pipe further comprises adjusting the sleeve relative to the base pipe such that the pressure drop in the production fluids traveling through the first set of openings, the annulus and the second set of openings is at a minimum.

22. The method as recited in claim 17 wherein the step of selectively positioning the sleeve relative to the base pipe further comprises adjusting the sleeve relative to the base pipe such that the pressure drop in the production fluids traveling through the first set of openings, the annulus and the second set of openings is between a minimum and a maximum pressure drop.

23. The method as recited in claim 17 wherein the step of selectively positioning the sleeve relative to the base pipe further comprises adjusting the sleeve relative to the base pipe using hydraulic pressure.

24. The method as recited in claim 17 wherein the step of selectively positioning the sleeve relative to the base pipe further comprises adjusting the sleeve relative to the base pipe such that the flow of the production fluids therethrough is prevented.

25. The method as recited in claim 17 wherein the step of selectively positioning the sleeve relative to the base pipe further comprises adjusting the sleeve relative to the base pipe using a mechanical shifting tool.

26. The method as recited in claim 1 wherein the step of selectively positioning the sleeve relative to the base pipe further comprises adjusting the sleeve relative to the base pipe using an electrically operated device.

27. The method as recited in claim 17 further comprising the step of measuring the pressure exteriorly of the production conduit and the pressure interiorly of the production conduit to determine the pressure drop in the production fluids.

28. The method as recited in claim 27 further comprising the steps of providing signals from a control circuit to control the relative position of the sleeve and the base pipe based upon the determined pressure drop in the production fluids.

29. A fluid flow control device for controlling the flow of a fluid therethrough comprising:

a first tubular member having a plurality of entry openings in a side wall thereof that allow the flow of the fluid therethrough;

a filter medium positioned exteriorly of the first tubular; and a second tubular member coaxially disposed within the first tubular member forming an annulus therebetween, the second tubular member having a plurality of exit openings in a side wall thereof that allow the flow of the fluid therethrough, the second tubular member rotatably selectively positionable relative to the first tubular member to adjust the alignment of the entry openings relative to the exit openings such that a pressure drop in the fluid is selectively controllable by adjusting an alignment of the entry openings relative to the exit openings, which adjusts the distance the fluid must travel in the annulus and alters the pressure drop in the production fluids traveling within the annulus.

30. The fluid flow control device as recited in claim 29 wherein the entry openings have substantially the same geometry as exit of openings.

31. The fluid flow control device as recited in claim 29 wherein the entry openings have a different geometry than the exit openings.

32. The fluid flow control device as recited in claim 29 wherein the entry openings have substantially the same shape as the exit openings.

33. The fluid flow control device as recited in claim 29 wherein the entry openings have a different shape than the exit openings.

34. The fluid flow control device as recited in claim 29 wherein the fluid flow control device has a fully open position wherein the pressure drop in the fluid traveling through the entry openings, the annulus and the exit openings is at a minimum.

35. The fluid flow control device as recited in claim 29 wherein at least one of an exterior surface of the second tubular member and an interior surface of the first tubular member is a turbulizer surface.

36. The fluid flow control device as recited in claim 29 wherein the fluid flow control device has a fully closed position wherein the flow of the fluid therethrough is prevented.

37. The fluid flow control device as recited in claim 29 wherein the fluid flow control device is adjustable between fully opened and fully closed positions.

38. The fluid flow control device as recited in claim 29 further comprising a first pressure sensor exteriorly positioned relative to the fluid flow control device and a second pressure sensor interiorly positioned relative to the fluid flow control device that are used to determine the pressure drop in the fluid flowing therethrough.

39. A fluid flow control device for controlling the flow of a fluid therethrough comprising:

first tubular member having a plurality of entry openings in a side wall thereof that allow the flow of the fluid therethrough;

a filter medium positioned exteriorly of the first tubular; and a second tubular member coaxially disposed within the first tubular member forming an annulus therebetween, the second tubular member having a plurality of exit openings in a side wall thereof that allow the flow of the fluid therethrough, the second tubular member axially and rotatably selectively positionable relative to the first tubular member to adjust the alignment of the entry openings relative to the exit openings such that a pressure drop in the fluid is selectively controllable by adjusting an alignment of the entry openings relative to the exit openings, which adjusts the distance the fluid must travel in the annulus and alters the pressure drop in the production fluids traveling within the annulus.

40. The fluid flow control device as recited in claim 39 wherein the entry openings have substantially the same geometry as exit of openings.

41. The fluid flow control device as recited in claim 39 wherein the entry openings have a different geometry than the exit openings.

42. The fluid flow control device as recited in claim 39 wherein the entry openings have substantially the same shape as the exit openings.

43. The fluid flow control device as recited in claim 39 wherein the entry openings have a different shape than the exit openings.

44. The fluid flow control device as recited in claim 39 wherein the fluid flow control device has a fully open position wherein the pressure drop in the fluid traveling through the entry openings, the annulus and the exit openings is at a minimum.

45. The fluid flow control device as recited in claim 39 wherein at least one of an exterior surface of the second tubular member and an interior surface of the first tubular member is a turbulizer surface.

46. The fluid flow control device as recited in claim 39 wherein the fluid flow control device has a fully closed position wherein the flow of the fluid therethrough is prevented.

47. The fluid flow control device as recited in claim 39 wherein the fluid flow control device is adjustable between fully opened and fully closed positions.

48. The fluid flow control device as recited in claim 39 further comprising a first pressure sensor exteriorly positioned relative to the fluid flow control device and a second pressure sensor interiorly positioned relative to the fluid flow control device that are used to determine the pressure drop in the fluid flowing therethrough.

49. A fluid flow control device for controlling the flow of a fluid therethrough comprising:

a first tubular member having a plurality of entry openings in a side wall thereof that allow the flow of the fluid therethrough;

a filter medium positioned exteriorly of the first tubular; and a second tubular member coaxially disposed within the first tubular member forming an annulus therebetween, the second tubular member having a plurality of exit openings in a side wall thereof that allow the flow of the fluid therethrough, at least one of an exterior surface of the second tubular member and an interior surface of the first tubular member is a turbulizer surface, the second tubular member selectively positionable relative to the first tubular member such that a pressure drop in the fluid is selectively controllable by adjusting an alignment of the entry openings relative to the exit openings, which adjusts the distance the fluid must travel in the annulus and alters the pressure drop in the production fluids traveling within the annulus.

50. The fluid flow control device as recited in claim 49 wherein the second tubular member is axially selectively positionable relative to the first tubular member to adjust the alignment of the entry openings relative to the exit openings.

51. The fluid flow control device as recited in claim 49 wherein the second tubular member is rotatably selectively positionable relative to the first tubular member to adjust the alignment of the entry openings relative to the exit openings.

52. The fluid flow control device as recited in claim 49 wherein the second tubular member is axially and rotatably selectively positionable relative to the first tubular member to adjust the alignment of the entry openings relative to the exit openings.

53. The fluid flow control device as recited in claim 49 wherein the entry openings have substantially the same geometry as exit of openings.

54. The fluid flow control device as recited in claim 49 wherein the entry openings have a different geometry than the exit openings.

55. The fluid flow control device as recited in claim 49 wherein the entry openings have substantially the same shape as the exit openings.

56. The fluid flow control device as recited in claim 49 wherein the entry openings have a different shape than the exit openings.

57. The fluid flow control device as recited in claim 49 wherein the fluid flow control device has a fully open position wherein the pressure drop in the fluid traveling through the entry openings, the annulus and the exit openings is at a minimum.

58. The fluid flow control device as recited in claim 49 wherein the fluid flow control device has a fully closed position wherein the flow of the fluid therethrough is prevented.

59. The fluid flow control device as recited in claim 49 wherein the fluid flow control device is adjustable between fully opened and fully closed positions.

60. The fluid flow control device as recited in claim 49 further comprising a first pressure sensor exteriorly positioned relative to the fluid flow control device and a second pressure sensor interiorly positioned relative to the fluid flow control device that are used to determine the pressure drop in the fluid flowing therethrough.

* * * * *